US011677197B2

(12) United States Patent
Chen

(10) Patent No.: US 11,677,197 B2
(45) Date of Patent: Jun. 13, 2023

(54) ELECTRICAL CONNECTOR HAVING A MOLDED METAL SUPPORT RECEIVING A CONTACT MODULE AND A METALLIC OUTER COVER SECURED TO THE SUPPORT THROUGH INTERPOSED MOLDED INSULATORS AND METHOD OF MAKING SAME

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Ding-Cherng Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 1 day.

(21) Appl. No.: 17/364,876

(22) Filed: Jun. 30, 2021

(65) Prior Publication Data

US 2021/0408741 A1 Dec. 30, 2021

(30) Foreign Application Priority Data

Jun. 30, 2020 (CN) ..... 202010621105.4

(51) Int. Cl.

| | |
|---|---|
| ***H01R 24/60*** | (2011.01) |
| ***H01R 43/02*** | (2006.01) |
| ***H01R 43/18*** | (2006.01) |
| ***H01R 13/627*** | (2006.01) |

(52) U.S. Cl.

CPC ..... *H01R 24/60* (2013.01); *H01R 13/6273* (2013.01); *H01R 43/0207* (2013.01); *H01R 43/18* (2013.01)

(58) Field of Classification Search

CPC .... H01R 24/60; H01R 13/502; H01R 13/504; H01R 13/516; H01R 13/521; H01R 13/5202; H01R 13/6273; H01R 13/6581; H01R 43/0207; H01R 43/18

See application file for complete search history.

(56) References Cited

U.S. PATENT DOCUMENTS

| | | | | |
|---|---|---|---|---|
| 9,871,318 | B2 * | 1/2018 | Wang | H01R 13/5216 |
| 2005/0142927 | A1 * | 6/2005 | Chen | H05K 5/0247 439/485 |

(Continued)

FOREIGN PATENT DOCUMENTS

| | | |
|---|---|---|
| CN | 107732529 A | 2/2018 |
| CN | 107565261 B | 7/2019 |

*Primary Examiner* — Oscar C Jimenez

(74) *Attorney, Agent, or Firm* — Ming Chieh Chang

(57) ABSTRACT

An electrical connector includes: a metallic cover; an insulative frame molded inside the metallic cover; a metal injection molded (MIM) support and a contact module received by the MIM support, the contact module having a rear base, a front tongue, and an upper and a lower rows of contacts extending through the base and exposing to two opposite faces of the tongue, the MIM support having a pair of side arms flanking the two rows of contacts; and an insulator molded outside the MIM support and the contact module and secured to the insulative frame.

13 Claims, 12 Drawing Sheets

(56) References Cited

U.S. PATENT DOCUMENTS

| | | | | |
|---|---|---|---|---|
| 2013/0183844 | A1* | 7/2013 | Wang | H01R 24/68<br>439/271 |
| 2015/0194761 | A1* | 7/2015 | Xie | H01R 24/60<br>439/521 |
| 2015/0263465 | A1* | 9/2015 | Zhang | H01R 13/6581<br>29/882 |
| 2016/0093974 | A1* | 3/2016 | Lai | H01R 13/521<br>439/736 |
| 2017/0373442 | A1 | 12/2017 | Qiu et al. | |
| 2018/0342839 | A1* | 11/2018 | Zhao | H01R 13/6585 |

* cited by examiner

ELECTRICAL CONNECTOR HAVING A MOLDED METAL SUPPORT RECEIVING A CONTACT MODULE AND A METALLIC OUTER COVER SECURED TO THE SUPPORT THROUGH INTERPOSED MOLDED INSULATORS AND METHOD OF MAKING SAME

BACKGROUND OF THE INVENTION

1. Field of the Invention

The present invention relates to an electrical connector having a metallic cover, an insulative frame molded inside the metallic cover, a metal injection molded (MIM) support and a contact module received by the MIM support, wherein an insulator is molded outside the MIM support and the contact module so as to be secured to the insulative frame instead of the metallic cover.

2. Description of Related Arts

China Patent No. 107732529 discloses an electrical connector comprising a metallic cover, an MIM support, an insulator molded with or mounted to the MIM support, and a contact module mounted to the insulator. The contact module has a rear base, a front tongue, and an upper and a lower rows of contacts extending through the base and exposing to two opposite faces of the tongue. The MIM support has a pair of side arms flanking the two rows of contacts. The metallic cover is directly mounted outside the MIM support such that a sealing effect therebetween is poor.

SUMMARY OF THE INVENTION

An electrical connector comprises: a metallic cover; an insulative frame molded inside the metallic cover; a metal injection molded (MIM) support and a contact module received by the MIM support, the contact module having a rear base, a front tongue, and an upper and a lower rows of contacts extending through the base and exposing to two opposite faces of the tongue, the MIM support having a pair of side arms flanking the two rows of contacts; and an insulator molded outside the MIM support and the contact module and secured to the insulative frame. A method of making such electrical connector is characterized by the steps of molding an insulative frame to a metallic cover, molding an insulator outside a metallic support and a contact module, and securing the insulator to the insulative frame.

DETAILED DESCRIPTION OF THE PREFERRED EMBODIMENT

Figure 1:
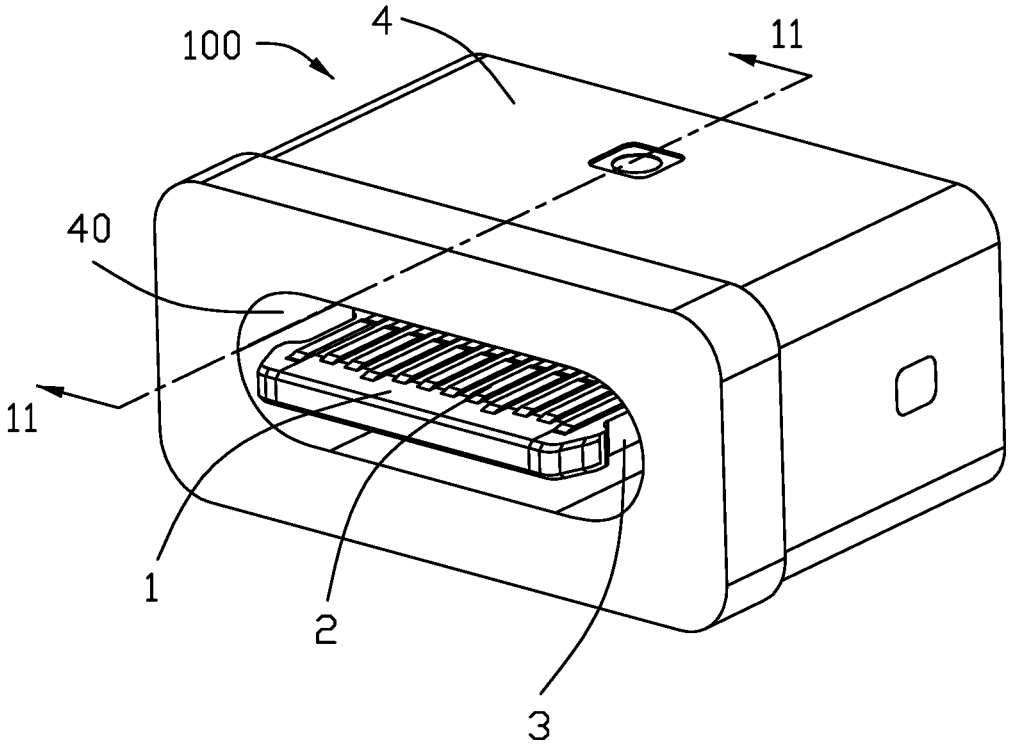
FIG. 1 is a perspective view of an electrical connector in accordance with the present invention.
Figure 2:
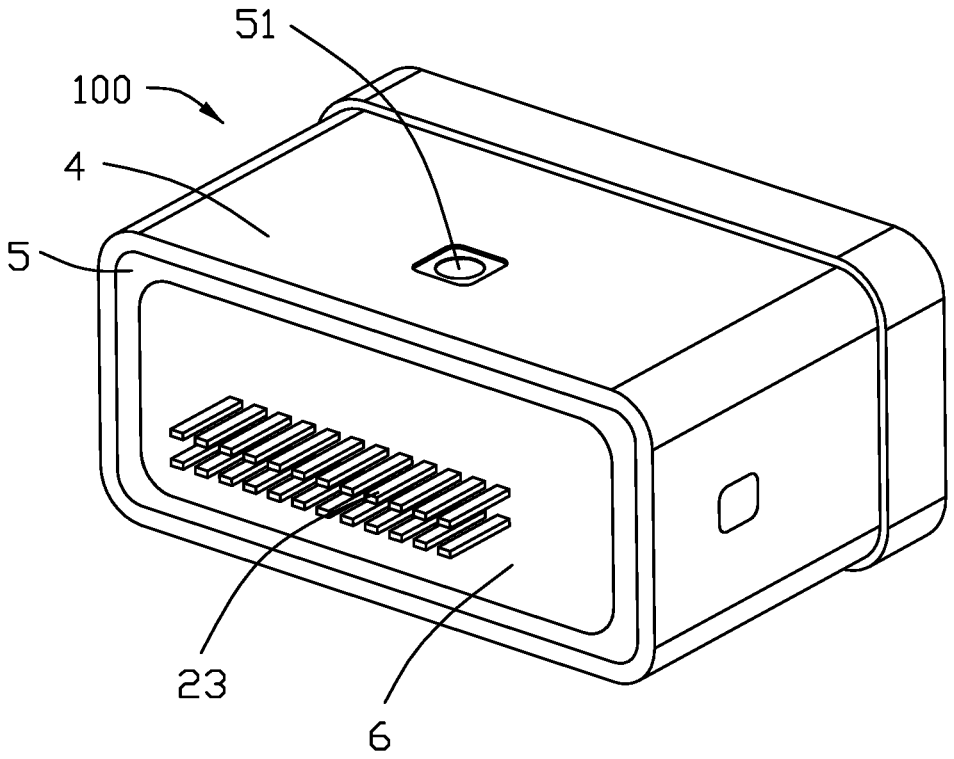
FIG. 2 is another perspective view of the electrical connector.
Figure 3:
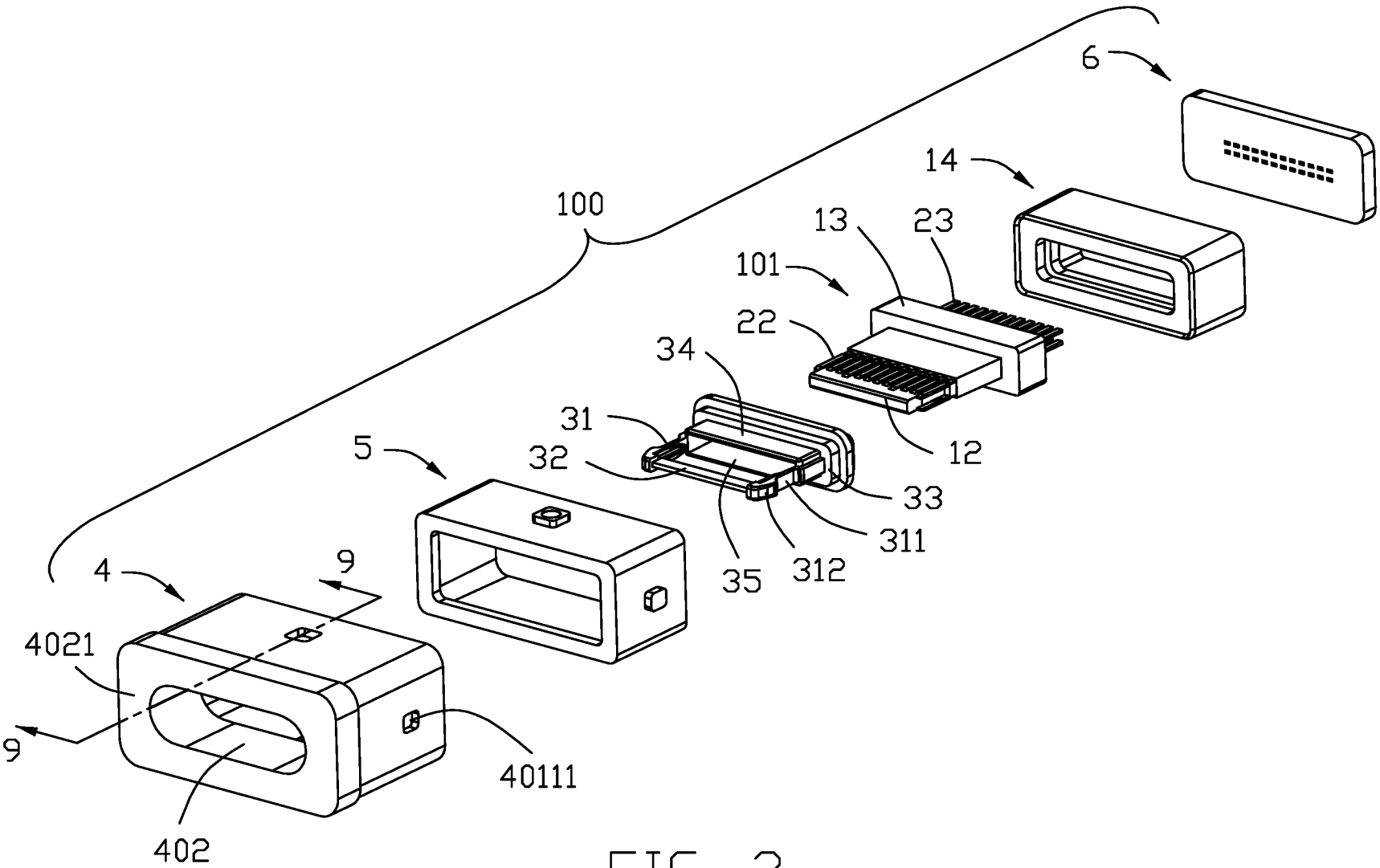
FIG. 3 is an exploded view of the electrical connector.
Figure 4:
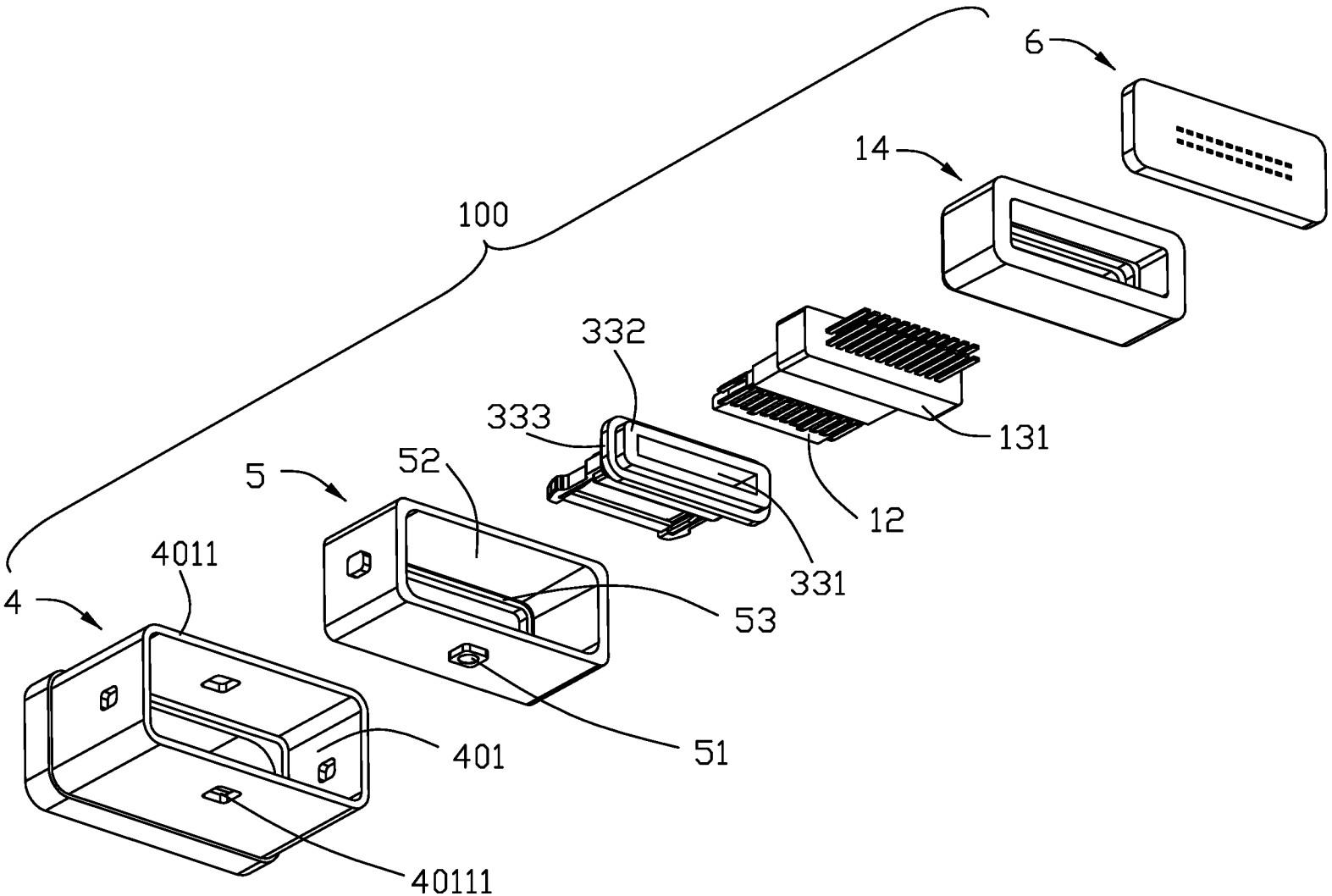
FIG. 4 is another exploded view of the electrical connector.
Figure 5:
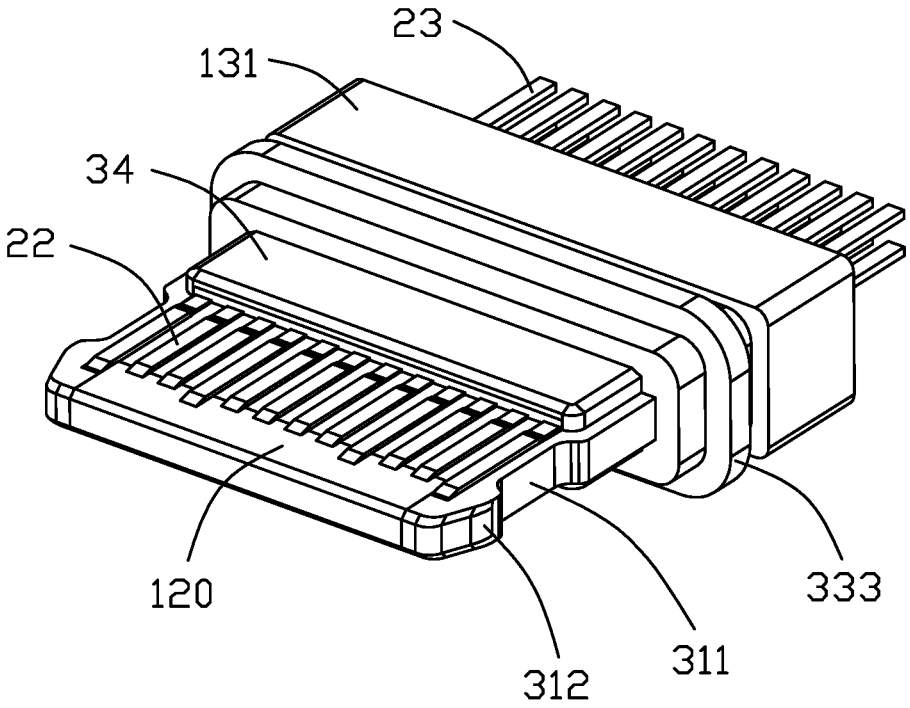
FIG. 5 is a perspective view of a metallic support and a contact module of the electrical connector.
Figure 6:
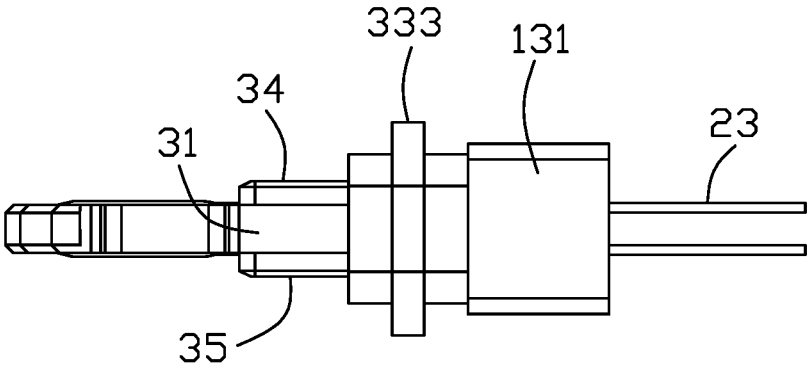
FIG. 6 is a side view of the metallic support and the contact module in FIG. 5.
Figure 7:
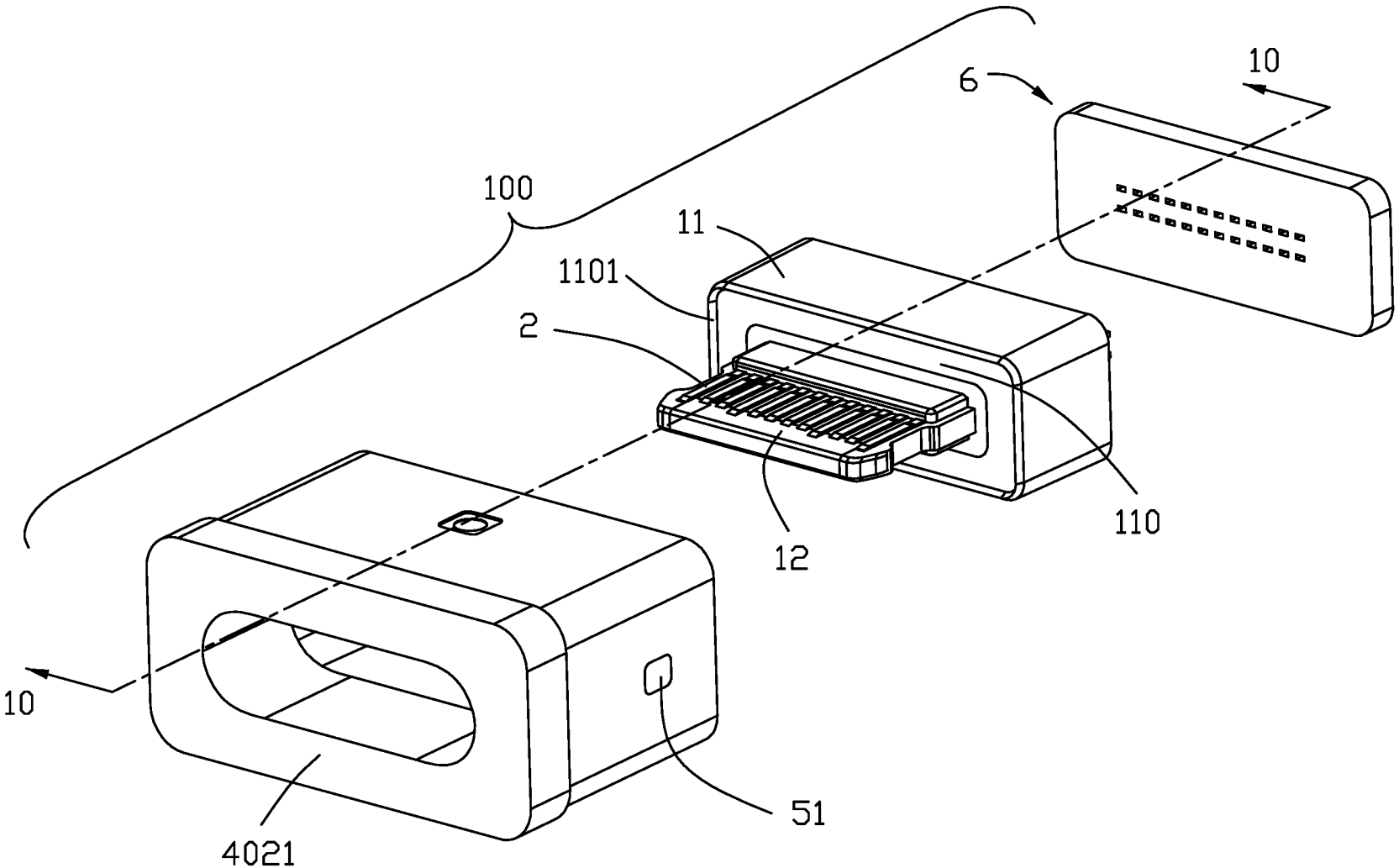
FIG. 7 is a partly exploded view of the electrical connector.
Figure 8:
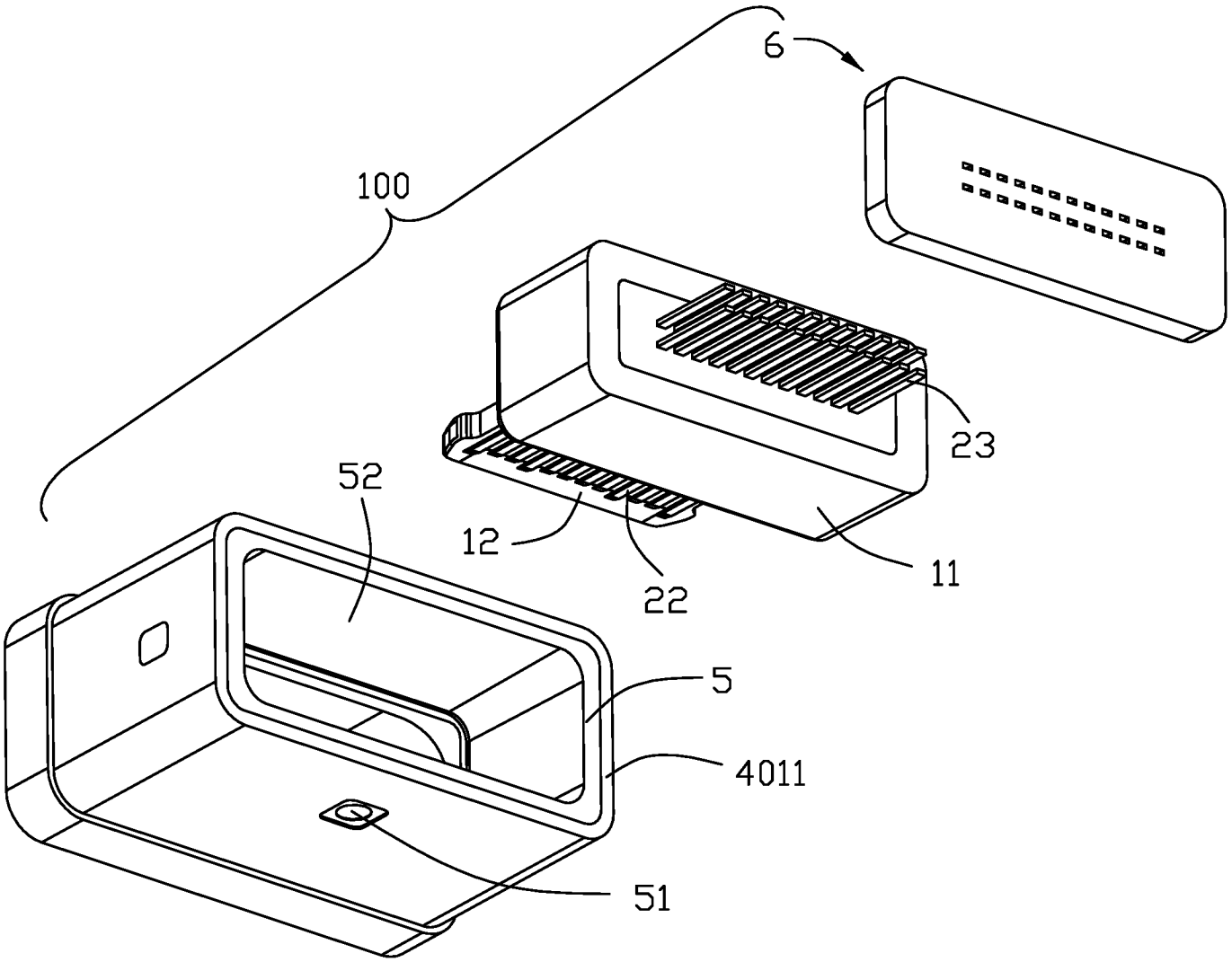
FIG. 8 is a view similar to FIG. 7 but from a different perspective.

Referring to FIGS. 1 to 12, an electrical connector 100 comprises an insulative housing 1, a plurality of contacts 2 secured in the insulative housing 1, a metallic support 3 secured to the insulative housing 1, a metallic cover 4 enclosing the insulative housing 1, and an insulative frame 5 secured in the metallic cover 4.

The insulative housing 1 includes a base unit 11 and a tongue 12. The plurality of contacts 2 include an upper and a lower rows of contacts extending through the base unit 11 and exposing to two opposite faces of the tongue 12. Each contact 2 has a securing portion 21, contacting portion 22, and a soldering portion 23. The metallic support 3 is made of a material of higher abrasion resistance and strength than a material of the insulative housing 1. The metallic support 3 may instead be made of a ceramic material. The metallic support 3 may be metallurgically formed or preferably is metal injection molded (MIM). The support 3 has a pair of side arms 31 flanking the two rows of contacts 2 to form together with the tongue 12 a tongue blade 120. Each side arm 31 has a latching notch 311 and a frontal protrusion 312. The support 3 further has a cross beam 32 and a body 33. The body has a through hole 331. The insulative housing 1 includes a base 13 which together with the two rows of contacts 2 defines a contact module 101. The base 13 has a block 131 from which the tongue 12 extends.

The contact module 101 is received by the support 3. Specifically, the contact module 101 is inserted through the hole 331 until the block 131 abuts a rear end face 332 of the body 33. The insulative housing 1 further includes an insulator 14 distinct from the base 13. The insulator 14 is molded over the body 33 and the block 131 to together form the base unit 11. The body 33 may have a protrusion 333 to obtain a better securement with the insulator 14. In addition, the body 33 may have first and second platforms 34 and 35 for engaging corresponding spring pieces of a complementary mating connector.

The metallic cover 4 may be metallurgically formed or metal injection molded as a seamless piece. The metallic cover 4 has a receiving space 40 defining a rear chamber 401 and a front chamber 402. The base unit 11 is disposed in the rear chamber 401 and the tongue blade 120 extends into the front chamber 402. To ensure a better sealing effect between the metallic support 3 and the metallic cover 4, the insulative frame 5 is molded in the rear chamber 401 of the metallic cover 4. The insulative frame 5 then may be suitably welded to the base unit 11, e.g., through ultrasonic welding. Specifically, the metallic cover 4 has a first peripheral wall 4021 and a second peripheral wall 4011. The second peripheral wall 4011 includes a pair of holes 40111 and the insulative frame 5 has a pair of protrusions 51 formed in the holes 40111 during molding operation. The insulative frame 5 has a chamber 52 receiving the base unit 11 and a frame wall 53 extending toward the chamber 52. A front face 110 of the base unit 11 and a rear face 530 of the frame wall 53 are welded together. Specifically, the front face 110 has a rib 1101 which is ultrasonic welded to the rear face 530.

Figure 9:
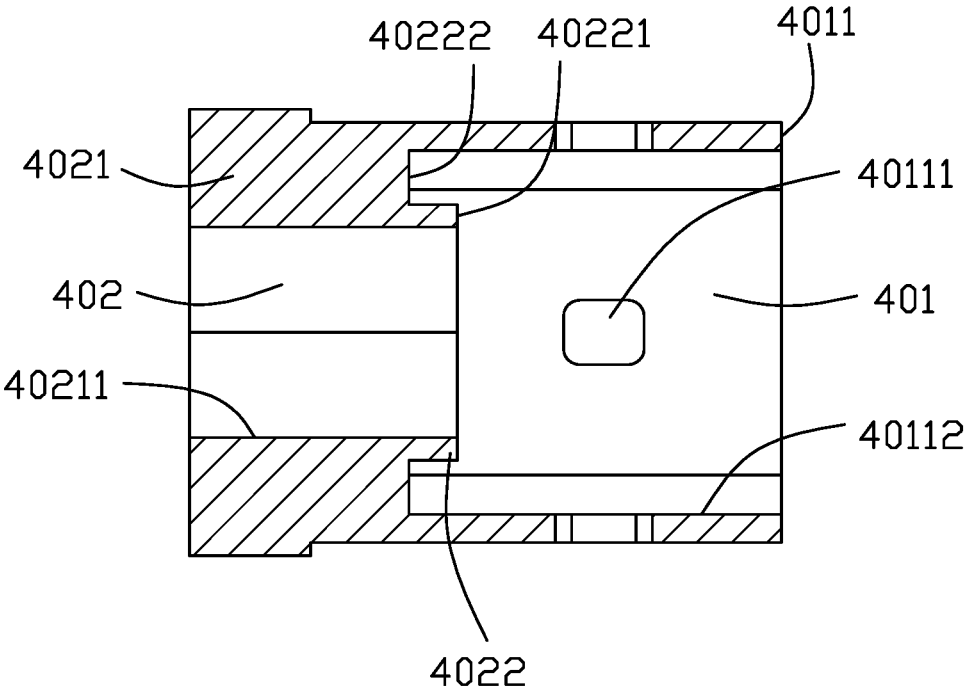
FIG. 9 is a cross-sectional view of the metallic support taken along line 9-9 in FIG. 3.
Figure 10:
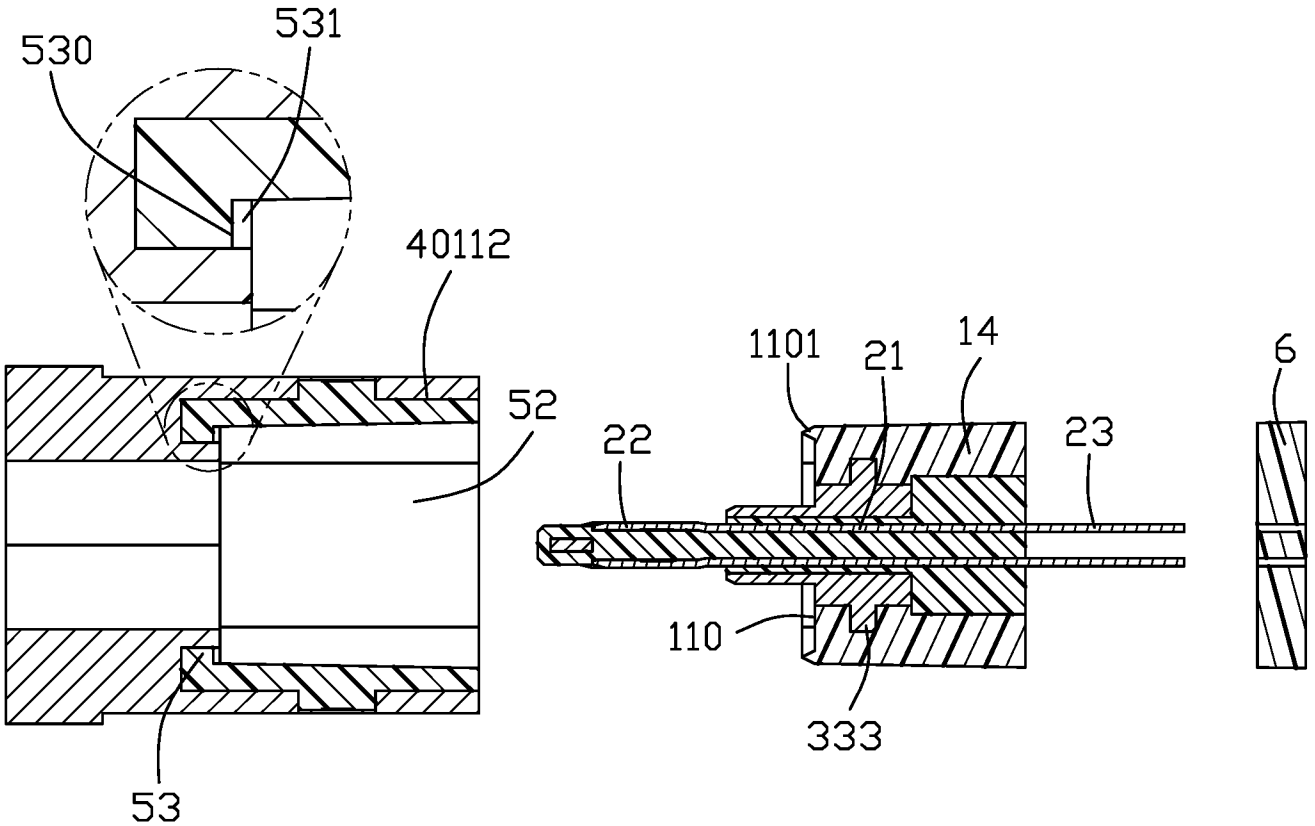
FIG. 10 is a cross-sectional view of the electrical connector taken along line 10-10 in FIG. 7.
Figure 11:
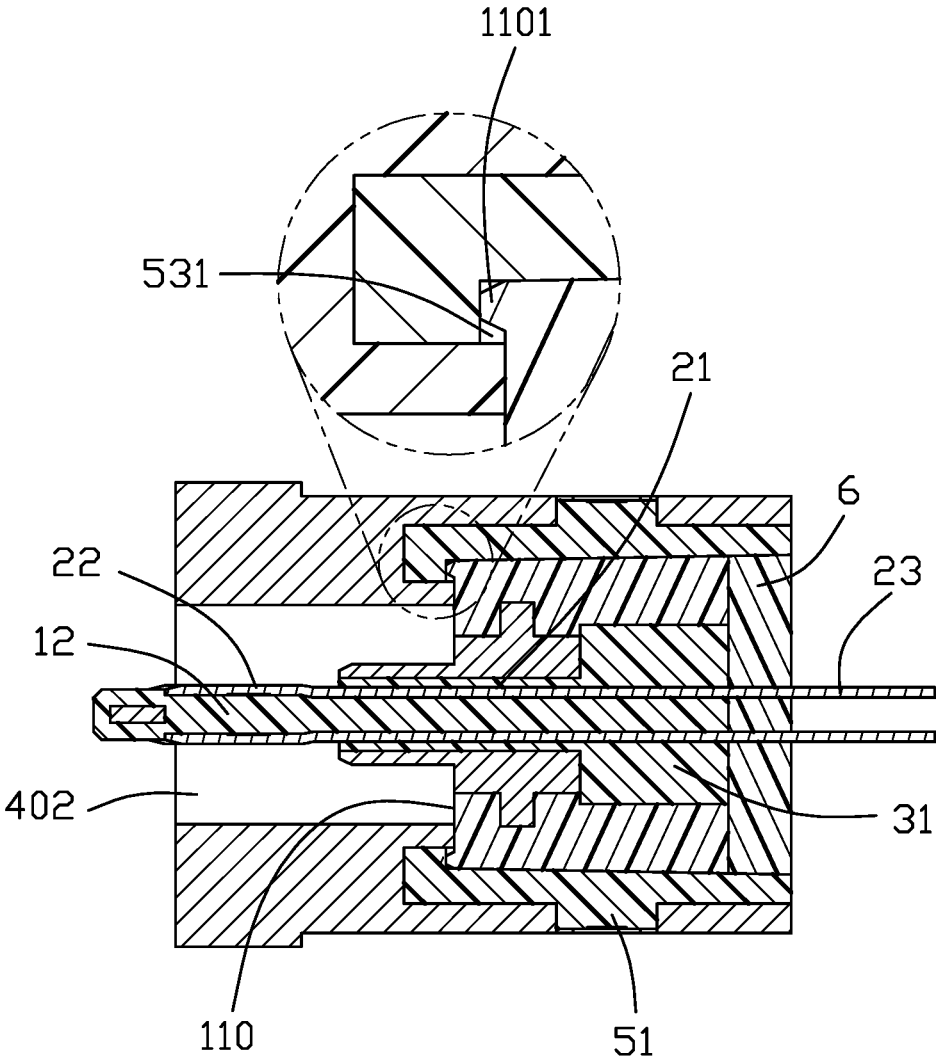
FIG. 11 is a cross-sectional view of the electrical connector taken along line 11-11 in FIG. 1.
Figure 12:
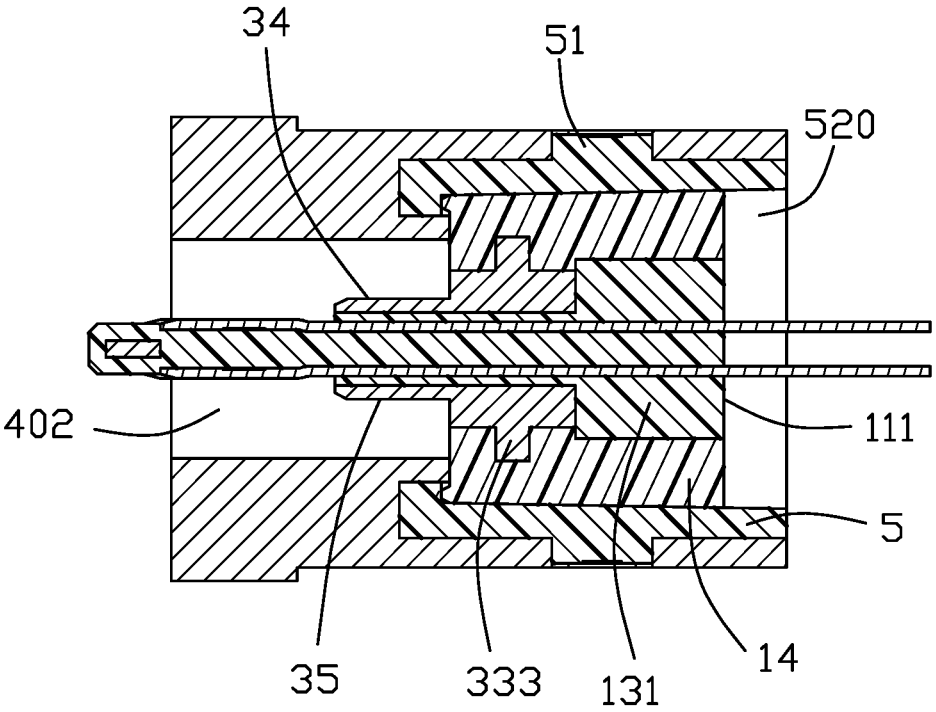
FIG. 12 is a view similar to FIG. 11 but omitting a sealing element of the electrical connector.

As is clearly seen in FIG. 9, an inner wall face 40112 of the second peripheral wall 4011 has an inner dimension that is greater than that of an inner wall face 40211 of the first peripheral wall 4021. A stop wall 4022 is formed near a front of the inner wall face 40112 of the second peripheral wall 4011 so that a rear face 40221 thereof is abutted by the front face 110 of the base unit 11. The frame wall 53 is also received in a groove 40222 of the first peripheral wall 4021. After the insulative frame 5 is molded in the rear chamber 401, the rear face 530 of the frame wall 53 is located in front of the rear face 40221 of the stop wall 4022 so as to form a groove 531. Therefore, the rib 1101 is ultrasonic welded in the groove 531 defined between the insulative frame 53 and the metallic cover 4 in order for vapor to escape during ultrasonic welding. In addition, a chamber 520 is formed behind a rear end face 111 of the base unit 11 for accommodating a sealing element 6.

With provision of the insulative frame 5 molded inside the metallic cover 4 to cooperate with the insulator 14 molded outside the MIM support 3 and the contact module 101, good sealing effect may be obtained between the metallic cover 4 and the MIM support 3.

What is claimed is:

1. An electrical connector comprising:

a metallic cover having a rear chamber and a front chamber;

an insulative frame molded inside the rear chamber of the metallic cover;

a metal injection molded (MIM) support and a contact module received by the MIM support, the contact module having a rear base, a front tongue extending into the front chamber, and upper and lower rows of contacts extending through the base and exposing to two opposite faces of the tongue, the MIM support having a pair of side arms flanking the two rows of contacts; and an insulator molded on the MIM support and secured to the insulative frame.

2. The electrical connector as claimed in claim 1, wherein the insulator is welded to the insulative frame.

3. The electrical connector as claimed in claim 2, wherein the insulative frame has a vertical wall defining a rear face, and the insulator has a front rib ultrasonic welded to the rear face.

4. The electrical connector as claimed in claim 2, wherein a groove is defined between the insulative frame and the metallic cover, and the insulator has a front rib ultrasonic welded in the groove.

5. The electrical connector as claimed in claim 1, wherein the metallic cover is metal injection molded.

6. The electrical connector as claimed in claim 1, wherein each of the pair of side arms has a latching notch.

7. The electrical connector as claimed in claim 1, further comprising a rear sealing element to seal between the insulator and the insulative frame.

8. A method of making an electrical connector, comprising the steps of:

molding an insulative frame to a rear chamber of a metallic cover;

molding a metallic support to include a pair of side arms;

forming a contact module to have a rear base, a front tongue extending into a front chamber of the metallic cover, and upper and lower rows of contacts extending through the base and exposing to two opposite faces of the tongue;

mounting the contact module to the metallic support with the pair of side arms flanking the two rows of contacts;

molding an insulator on the metallic support; and securing the insulator to the insulative frame.

9. The method as claimed in claim 8, wherein the securing step comprises a step of welding the insulator to the insulative frame.

10. The method as claimed in claim 9, wherein the insulative frame has a vertical wall defining a rear face and the insulator has a front rib, and the welding step comprises ultrasonic welding the front rib of the insulator to the rear face of the insulative frame.

11. The method as claimed in claim 8, further comprising a step of metal injection molding the metallic cover.

12. The method as claimed in claim 8, wherein the step of molding the metallic support comprises forming each of the pair of side arms to have a latching notch.

13. The method as claimed in claim 8, further comprising a step of forming a rear sealing element to seal between the insulator and the insulative frame.

* * * * *